US006971514B2

(12) United States Patent
VanderWerf et al.

(10) Patent No.: US 6,971,514 B2
(45) Date of Patent: Dec. 6, 2005

(54) CORNER GUARD FOR PRE-HUNG DOOR ASSEMBLY

(76) Inventors: John D. VanderWerf, 467 Inland Way, Atlantic Beach, FL (US) 32233; Thomas E. Levitt, 13725 SW. 28th Ct., Beaverton, OR (US) 97008; Paul L. Verstrate, 790 SW. 238th Ave., Hillsoboro, OR (US) 97123

( * ) Notice: Subject to any disclaimer, the term of this patent is extended or adjusted under 35 U.S.C. 154(b) by 105 days.

(21) Appl. No.: 10/657,975

(22) Filed: Sep. 9, 2003

(65) Prior Publication Data

US 2005/0050688 A1 Mar. 10, 2005

(51) Int. Cl.[7] ..... B65D 81/07

(52) U.S. Cl. ..... 206/325; 206/453; 206/586; 248/345.1

(58) Field of Search ..... 206/325, 453, 206/586; 248/188.9, 354, 345.1; 428/99, 428/122, 188; 229/199; 49/380

(56) References Cited

U.S. PATENT DOCUMENTS

| | | | | |
|---|---|---|---|---|
| 2,740,658 A | | 4/1956 | Kesich | |
| 2,742,146 A | | 4/1956 | Lester, Jr. | |
| 2,822,920 A | | 2/1958 | Lieber | |
| 2,887,219 A | | 5/1959 | Lester, Jr. | |
| 2,929,495 A | | 3/1960 | Simonsen | |
| 3,194,396 A | | 7/1965 | Mock | |
| 3,419,933 A | * | 1/1969 | Gossen | 16/94 R |
| 3,580,469 A | | 5/1971 | Reese | |
| 3,655,034 A | | 4/1972 | Stollman et al. | |
| 4,063,702 A | * | 12/1977 | Wilde et al. | 248/345.1 |
| 4,923,759 A | * | 5/1990 | Brooks et al. | 428/521 |
| 4,967,905 A | | 11/1990 | Steves | |
| 5,054,613 A | | 10/1991 | Johansson | |
| 5,065,972 A | * | 11/1991 | Buckshaw et al. | 248/345.1 |
| 5,149,575 A | * | 9/1992 | Soifer | 428/188 |

(Continued)

FOREIGN PATENT DOCUMENTS

DE 3701293 A1 * 4/1988

OTHER PUBLICATIONS

Material Handling Tools brochure—pp. 22-23.

*Primary Examiner*—David T. Fidei
(74) *Attorney, Agent, or Firm*—Thomas C. Saitta

(57) ABSTRACT

An improved corner guard for use on a pre-hung door assembly. The corner guard of the present invention is designed for use with a pre-hung door assembly that includes a door secured within a three-sided door frame in which the two vertical frame members extend in an offset manner below the bottom edge of the pre-hung door. In a preferred embodiment, the corner guard includes a bumper member for imposing a gap between adjacent stacked assemblies. A substantially flat transition flange member is attached to one end of the base of the bumper member, and together, the transition flange member and bumper member base form a retention barrier surface across the front corner region of the pre-hung door assembly to maintain the door securely seated within the door frame. A fixed side flange is affixed to the other end of the bumper member and extends approximately perpendicularly with respect to the bumper member base surface such that a right angle inner surface corner contour is formed therebetween. The corner guard further includes an outwardly extensible lip member affixed to the other end of the transition flange member for enabling the corner guard to be deployed either to a right angle top corner or an L-shaped bottom corner region of the pre-hung door assembly.

18 Claims, 6 Drawing Sheets

U.S. PATENT DOCUMENTS 5,488,804 A 2/1996 Batscher
5,595,301 A 1/1997 Putz et al.
5,603,403 A 2/1997 Sather
6,012,579 A 1/2000 Tindoll et al.
6,029,410 A 2/2000 Westberg, II et al.
6,368,694 B1 * 4/2002 Marsh et al. ..... 428/99
6,478,354 B1 11/2002 Eyal
2003/0005641 A1 * 1/2003 Eakes et al. ..... 49/380

* cited by examiner

CORNER GUARD FOR PRE-HUNG DOOR ASSEMBLY

BACKGROUND OF THE INVENTION

1. Technical Field

The present invention relates generally to protective packaging devices and in particular to protective packaging devices for protecting pre-hung door assemblies during transport and handling.

2. Description of the Related Art

Responding to the prevalent popularity of delivering doors and door frames as pre-assembled units, door manufacturers and distributors have devised different types of protective packaging devices for protecting these products in assembled form while in storage and transit. Each of these protective package devices is essentially designed to protect the door assemblies from outer surface damage and to securely retain the hinged door within its frame. To this end, a variety of protective devices have been developed that protectively cover the corners of the assemblies and/or prevent the door from swinging free of the frame. A common approach to protecting the corner areas of a pre-hung door assembly is to install corrugated cardboard corner guards at each of the four corner regions of the door assembly. Such corrugated cardboard corner guards are typically folded and glued into suitable box-like pockets that fit relatively loosely around the respective corner regions of the door assembly and are held in place with straps. However, due to the tendency of cardboard corner guards to slip off or tear during shipment handling, alternate corner guard designs are becoming increasingly popular.

Alternative corner guards, made of plastics or similar high-tensile strength materials, have been developed to replace the corrugated cardboard corner protectors. Referring to FIGS. 1A and 1B, for example, there are illustrated perspective views of a conventional "top" corner guard 10 and a conventional "bottom" corner guard 15 that are utilized, respectively, to protect one of two top corners and one of two bottom corners of a pre-hung door assembly. Although the door assembly is not depicted in its entirety, it can be readily appreciated that such a door assembly includes a three-sided door frame comprising a pair of vertical side frame members (e.g. the hinge and strike jambs) joined by a cross frame member (e.g. head jamb). In this manner, the pre-hung door assembly is characterized as having two flush, right angle corners formed at the vertical-to-cross frame junctions at its top side, and a pair of L-shaped bottom corner regions in which the bottom edge of the door is recessed by one to two inches from the bottoms of the vertical frame members that extend along the sides thereof.

Top corner guard 10, depicted in FIG. 1A, is representative of one of two such top corner guards utilized to protect the top corners of a door frame. As shown in FIG. 1A, top corner guard 10 is deployed over and in flush contact with the right angle junction of frame members 6 of a pre-assembled door frame. Top corner guard 10 includes a pair of mutually perpendicularly opposing side flanges 12 that are securely fastened to the outside edge surfaces of a pair of frame members 6 by the use of staples 4 or other suitable attachment means. A triangular cross member flange 14 connectively extends between side flanges 12 to form a three-sided composite that protects the surface of the top frame corner while simultaneously preventing the door 8 from swinging free from the door frame jambs.

Referring to FIG. 1B, there is illustrated a conventional bottom corner guard 15 deployable on a bottom L-shaped region of a pre-hung door assembly. As depicted in FIG. 1B, bottom corner guard 15 includes a pair of side flanges 12 and cross member flange 14, together providing protective and door retention functions analogous to those provided by top corner guard 10. In contrast to the seamless three-sided construction of top corner guard 10, bottom corner guard 15 requires a slot aperture separation between side flanges 12 through which the bottom of the vertical frame member 6 extends to accommodate the L-shaped door edge-to-frame junction.

Being made of plastic or other high tensile strength and tear-resistant materials, top and bottom corner guards 10 and 15 need only be anchored, using wood staples or similar coupling means, to one side edge of the door frame thus eliminating the need to be formed as pocket-like enclosures. However, the need for two distinctly different corner guard structures (i.e. corner guard 10 for top corners and corner guard 15 for bottom corners) significantly increases the cost of production for providing comprehensive corner guard protection for each pre-hung door assembly. Furthermore, bottom corner guard 15 fails to cover and therefore protect the bottom edge and corner surfaces of frame member 6.

FIG. 2 illustrates a door-to-frame strap 16, which may be constructed of plastic or like material, that addresses the problem of leaving the bottom edge and corner surfaces of frame member 6 exposed. Door-to-frame strap 16 includes a flat strip 18 that is secured to the bottom edge of door 8 by the use of staples 4 or other suitable attachment means, and furthermore includes a corner flange 17 having a hook-like or L-shaped contour enabling corner flange 17 to conformably grip and cover the corner edges of the bottom of frame member 6. As shown in FIG. 2, strip 18 is a substantially flexible member that flexes in a bow like manner toward the corner flange 17 thus enabling door-to-frame strap 16 to accommodate a variety of different frame-member-to-door offset distances.

The corner protection devices shown in FIGS. 1A and 1B requires at least two different types of corner guards to cover the right angle top corners and L-shaped bottom corners of a pre-hung door assemblies, and furthermore fails to adequately protect the two L-shaped bottom corner regions where the vertical frame member extends below the bottom edge of the door. While the door-to-frame strap 16 depicted in FIG. 2 protectively covers the bottom corners of the vertical frame members extending beyond the bottom edge of the door 8, the single connective attachment point on the bottom edge of door 8 combined with a lack of frontal retention support, such as that provided by cross member flanges 14, leaves door-to-frame strap 16 vulnerable to being dislodged and otherwise insufficient for retaining door within the frame.

It can therefore be appreciated that a need exists for an improved corner guard for pre-hung door assemblies. The present invention addresses such a need.

SUMMARY OF THE INVENTION

An improved corner guard for use on a pre-hung door assembly is disclosed herein. The corner guard of the present invention is designed for use with a pre-hung door assembly that includes a door secured within a three-sided door frame in which the two vertical frame members extend in an offset manner below the bottom edge of the pre-hung door. In a preferred embodiment, the corner guard includes a bumper member for imposing a gap between adjacent stacked assemblies. A substantially flat transition flange member is attached to one end of the base of the bumper member, and together, the transition flange member and bumper member base form a retention barrier surface across the front corner region of the pre-hung door assembly to maintain the door securely seated within the door frame. A fixed side flange is affixed to the other end of the bumper member and extends approximately perpendicularly with respect to the bumper member base surface such that a right angle inner surface corner contour is formed therebetween. The corner guard further includes an outwardly extensible lip member affixed to the other end of the transition flange member for enabling the corner guard to be deployed either to a right angle top corner or an L-shaped bottom corner region of the pre-hung door assembly.

All objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF A PREFERRED EMBODIMENT

The present invention is described in a preferred embodiment in the following description with reference to the figures. While this invention is described in terms of the best mode for achieving this invention's objectives, it will be appreciated by those skilled in the art that variations may be accomplished in view of these teachings without deviating from the spirit or scope of the present invention.

Figure 1A:
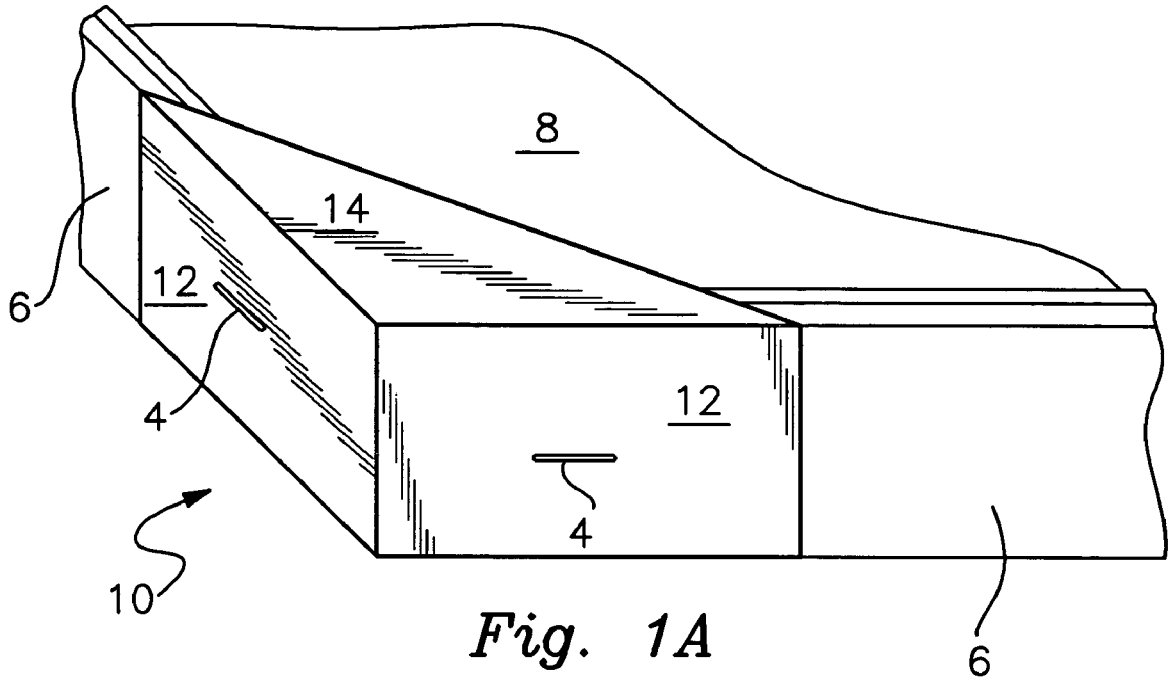
Fig. 1A (Prior Art)
FIGS. 1A and 1B depict perspective views of conventional plastic corner guards deployable on a top right angle junction and on a bottom L-shaped corner region of a pre-hung door assembly.
Figure 1B:
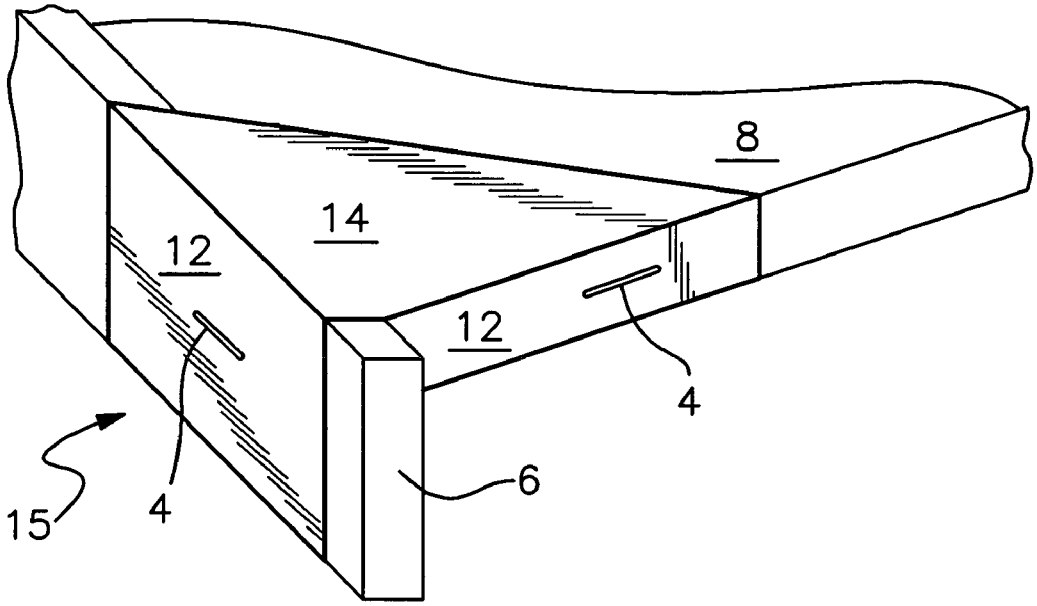
Fig. 1B (Prior Art)
Figure 2:
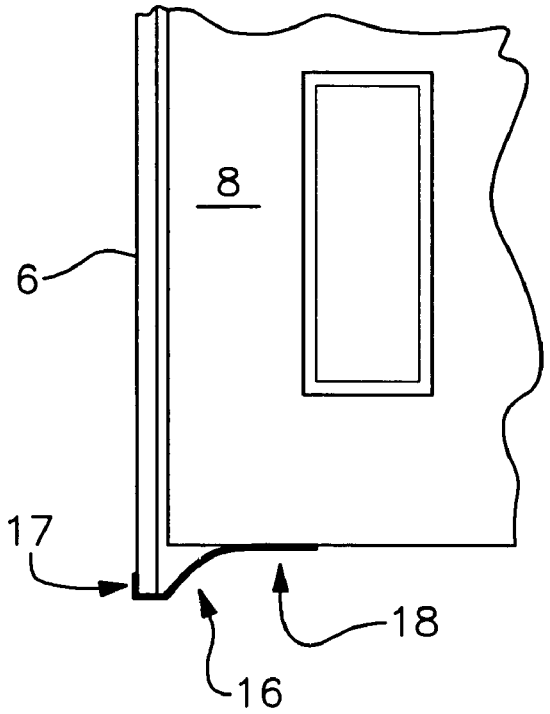
Fig. 2 (Prior Art)
FIG. 2 is a front view depicting a conventional door-to-frame strap utilized to protectively cover the bottom-extending portion of a vertical frame member.
Figure 3A:
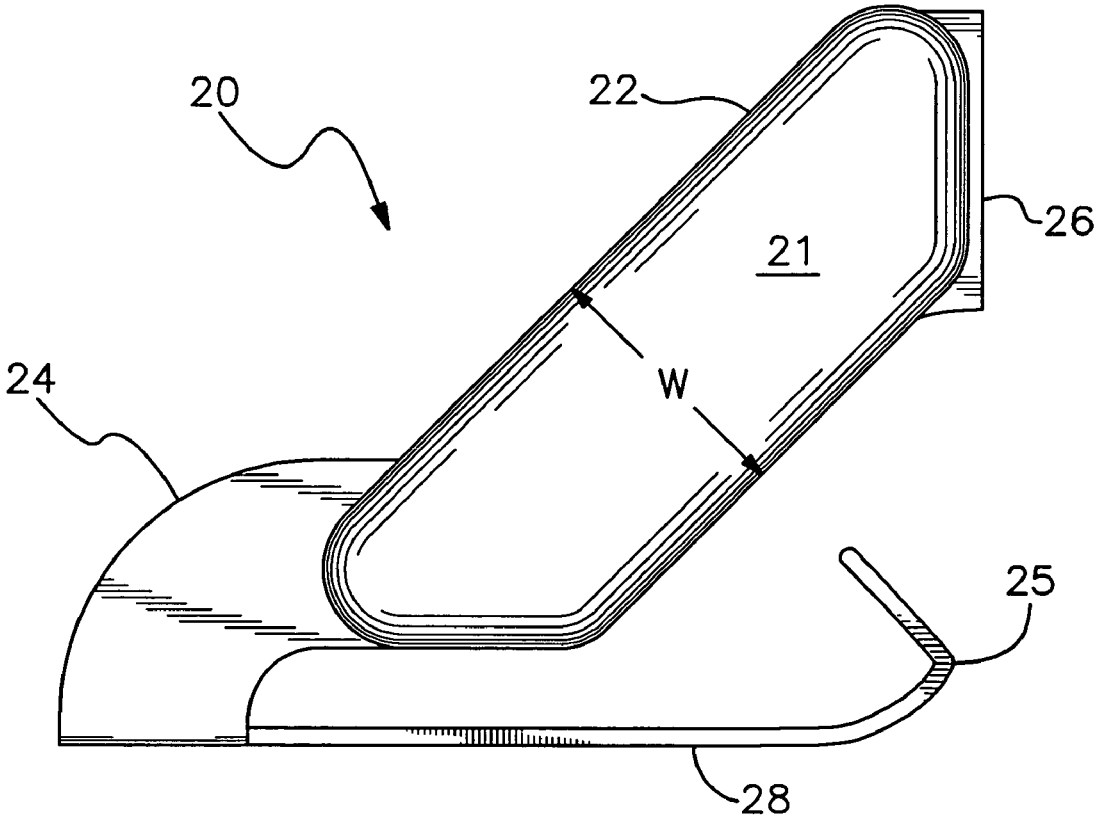
FIG. 3A is a front profile view illustrating a corner guard applicable to a top or bottom corner of a pre-hung door assembly in accordance with a preferred embodiment of the present invention.
Figure 3B:
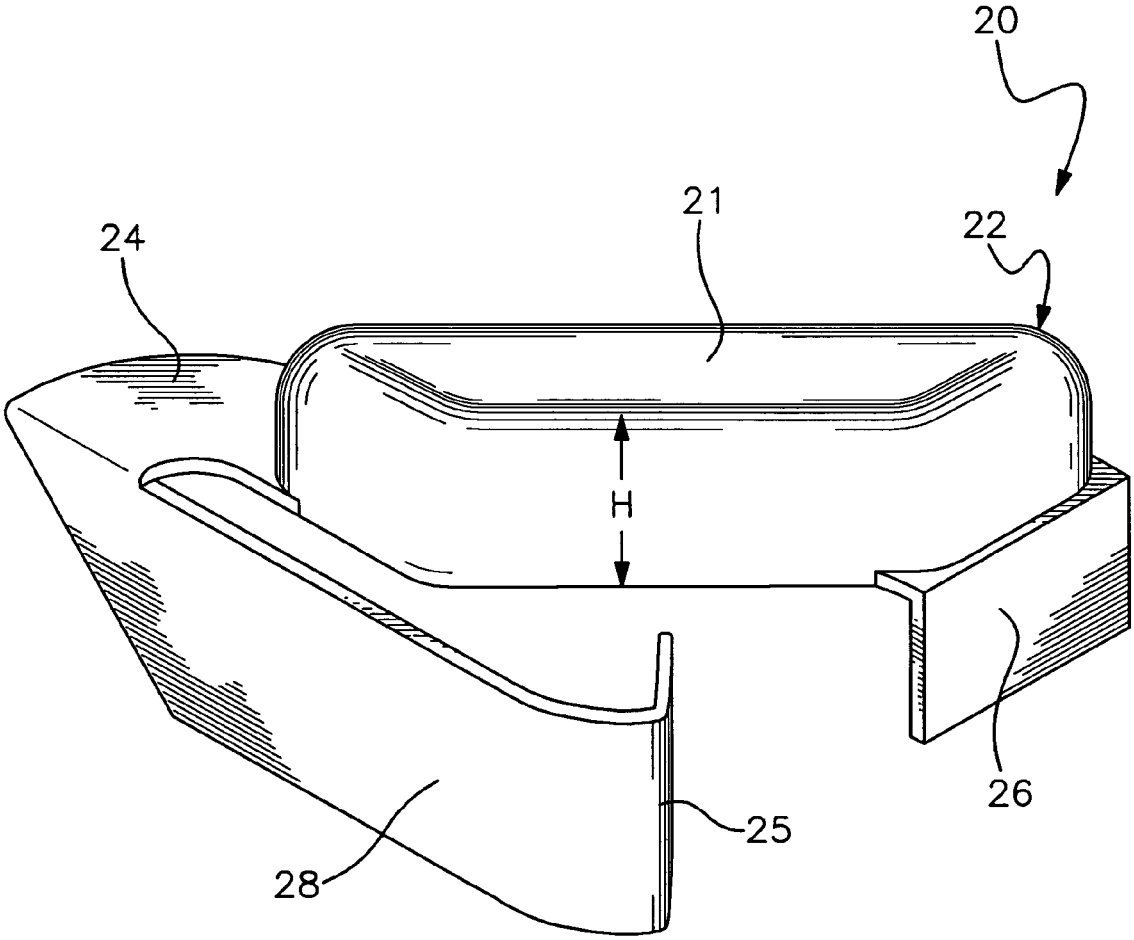
FIGS. 3B and 3C are alternate perspective views of the corner guard depicted in FIG. 3A.
Figure 3C:
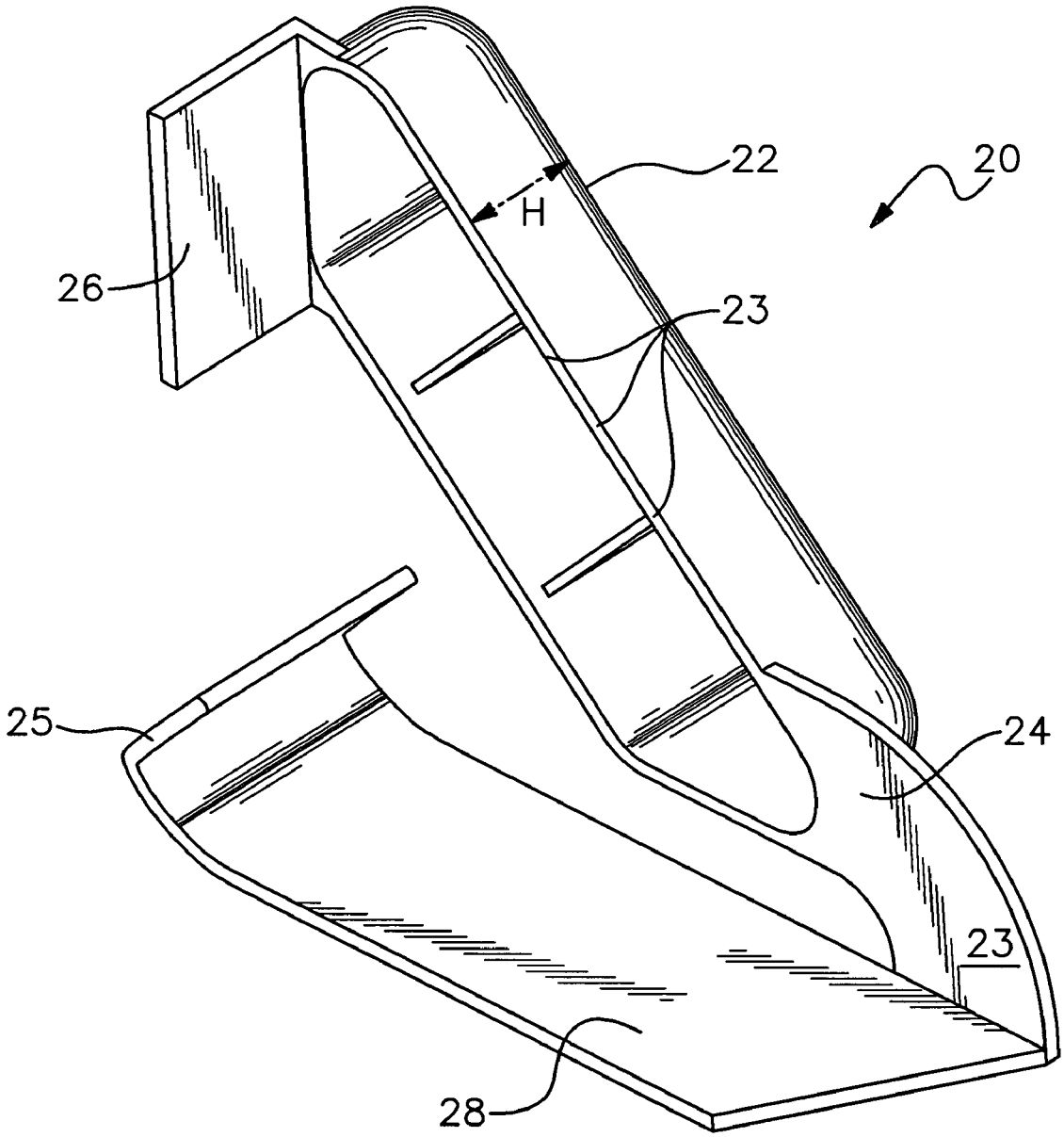

With reference now to the figures, wherein like reference numerals refer to like and corresponding parts throughout, and in particular with reference to FIGS. 3A–3C, there are depicted a front profile view and alternate front and rear perspective views of a corner guard 20 designed in accordance with a preferred embodiment of the present invention. Specifically, corner guard 20 includes a frontal barrier member comprising a bumper member 22 attached to a transition flange 24. As depicted in further detail with reference to FIG. 3C and FIGS. 4A–4C, the frontal barrier member formed by the combination of bumper member 22 and transition flange 24 provides an inner base surface 23 across a front corner region of a pre-hung door assembly 35 such that the object door is secured (i.e. remains seated) within the door frame jambs. In addition to providing door retention functionality, bumper member 22 preferably has a raised, bumper-like outer contour that creates an inter door assembly gap between adjacently stacked door assemblies to prevent protruding members such as door hinges from damaging the door surface. In order to ensure an adequate inter door assembly gap, the height, H, of bumper member 22 must exceed the distance that a standard door hinge (not depicted) protrudes from the front of a door frame assembly, and, balancing the need for adequate clearance against cost of materials, is preferably set between 0.875" and 1.25". In addition to increased cost of materials, increasing the height, H, of bumper member 22 without proportionately increasing its width, W, compromises its stability in terms of resistance to bending or folding when the weight of an adjacent door frame assembly is applied against it. Therefore, and in accordance with the foregoing height dimension range, the width, W, of bumper member 22 is preferably set between 1.25" and 1.50" such that the resultant width-to-height ratio of bumper member 22 is at least 1.0. As an additional stabilization feature, bumper member 22 preferably includes a substantially flat outer bumper surface 21.

Affixed to the end of bumper member 22, opposing the end attached to transition flange 24, is a fixed side flange 26 that extends substantially perpendicularly with respect to the inner base surface 23 of the frontal barrier member such that a right angle inner surface corner contour is formed therebetween. As illustrated in FIG. 3C and FIGS. 4A–4C, the right angle corner junction between inner base surface 23 and side flange 26 provides a suitably contoured forum in which corner guard 20 may be securely braced at one end onto a rectangular frame member.

In an important feature of the present invention, corner guard 20 further includes an outwardly extensible lip member 28 coupled to transition flange 24. As depicted in the figures herein, lip member 28 is a resiliently flexible strip-like member having a proximal end fixedly attached to the frontal barrier member at the end of transition flange 24. Lip member 28 further includes a free distal end at which lip member 28 is extensible in a flexible, bow-like manner outward and away from the frontal barrier member comprising bumper member 22 and transition flange 24. Similar to the right angle junction formed between side flange 26 and the barrier surface 23 of the frontal barrier member, the mutual disposition of the flat strip portion of lip member 28 is perpendicular with respect to inner base surface 23, thus providing a right angle brace between transition flange 24 and the proximal end of lip member 28 for securely bracing the end of the frontal barrier member onto a rectangular frame member or the bottom door edge.

Figure 4A:
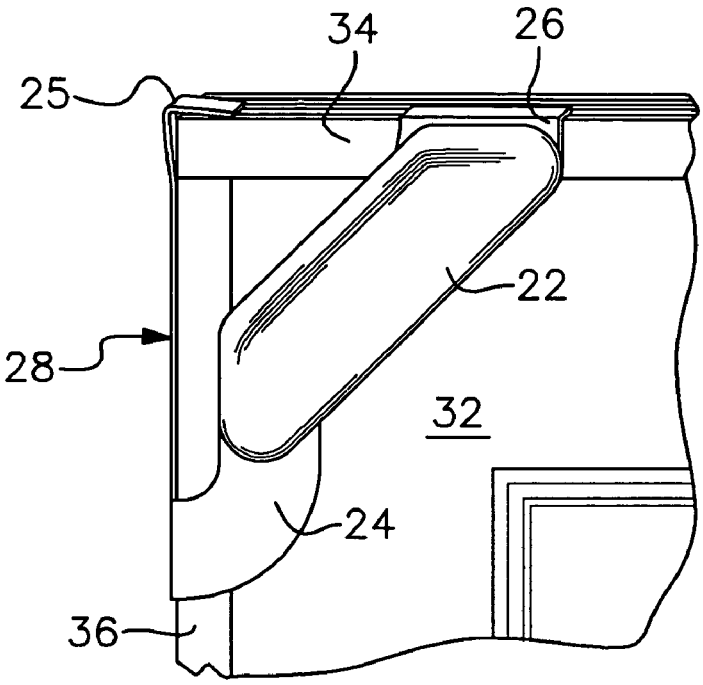
FIGS. 4A–4C illustrate the corner guard of the present invention deployed on the top and bottom corners of a pre-hung door assembly in accordance with a preferred embodiment of the present invention.
Figure 4B:
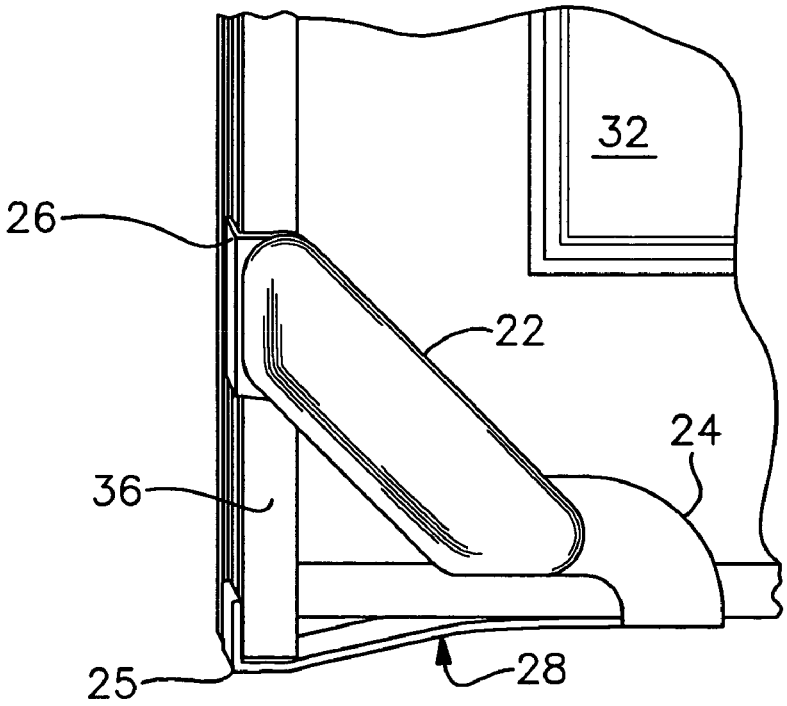
Figure 4C:
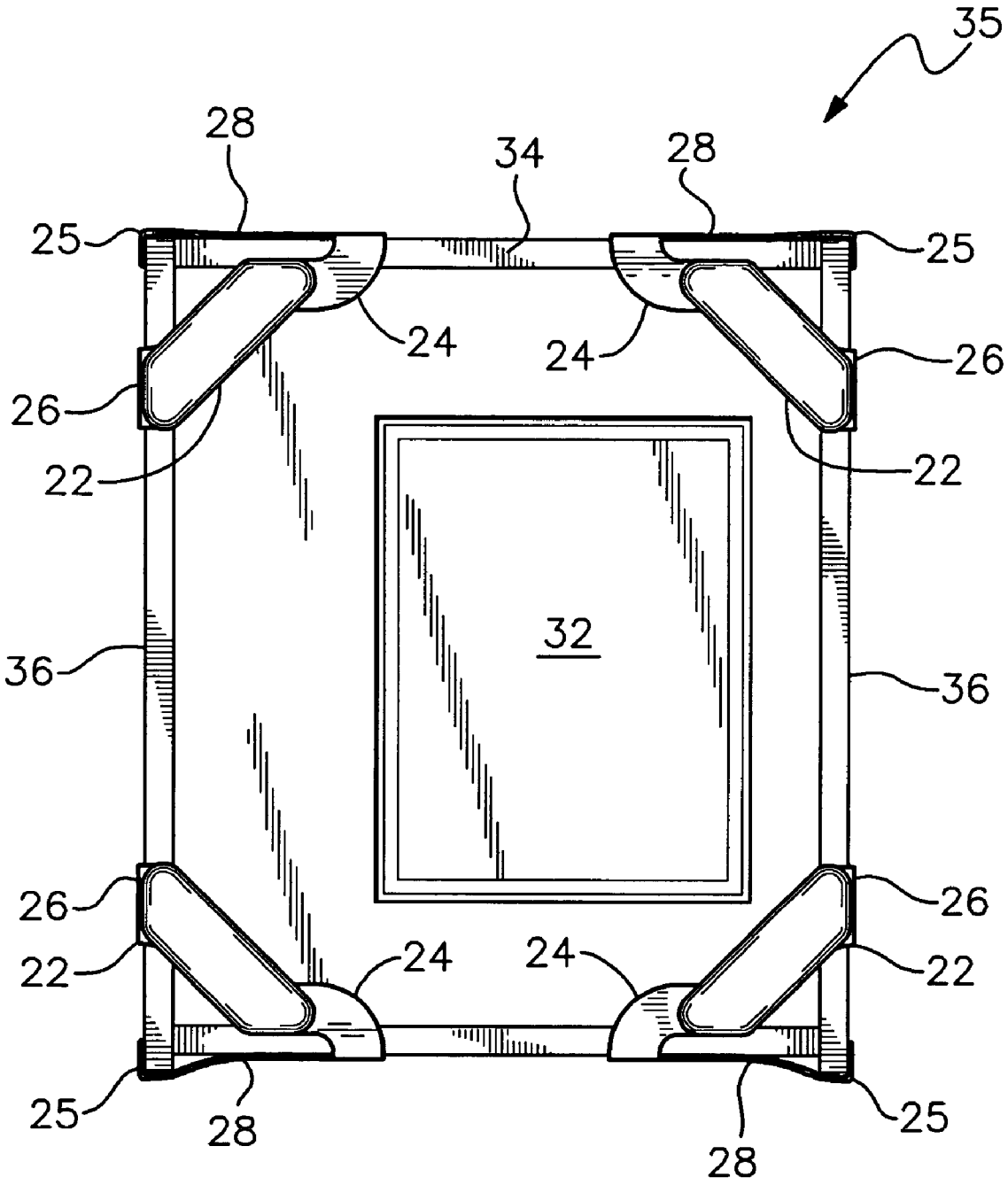

With reference to FIGS. 4A–4C, there is illustrated the corner guard of the present invention deployed on the top and bottom corners of a pre-hung door assembly in accordance with a preferred embodiment of the present invention. As shown in FIG. 4C, a pre-hung door assembly 35 includes a three-sided door frame comprising a pair of vertical frame members (e.g. the hinge and strike jambs) 36 joined by a cross frame member (e.g., head jamb) 34. In this manner, pre-hung door assembly 35 is characterized as having two flush, right angle corners formed at the vertical-to-cross frame junctions at its top side, and a pair of L-shaped bottom corner regions in which the bottom side of the door is recessed by one to two inches from the bottoms of the vertical frame members that extend along the sides thereof.

Door 32 is attached to one of the side jambs 36 known as the "hinge jamb," by two or more door hinges (not depicted). The inter door assembly gap of between 0.875" and 1.25" provided by bumper member 22 prevents the protruding metallic hinges from damaging the wood surface of an adjacent door assembly surface. Furthermore, the inner base surface 23 provided by the frontal barrier member comprising bumper member 22 and transition flange 24, prevents door 32 from swinging free from its seated position within the door frame members. Referring to FIGS. 3A–3C in conjunction with FIGS. 4A–4C, it will be noted that corner guard 20 may be formed in one of two complementary orientations, with the corner guard embodiment depicted in FIGS. 3A–3C deployable on the upper left corner or lower right corner of a pre-hung door assembly 35, and a similarly constructed but oppositely oriented corner guard deployable on the upper right and lower left corners.

FIGS. 3B and 3C illustrate alternate perspective views of corner guard 20 showing the relative positioning of side flange member 26, transition flange 24, and outwardly extensible lip member 28 relative to the outer and inner contours of the frontal barrier member comprising bumper member 22 and transition flange 24. As explained above, inner base surface 23, comprising the underneath surfaces of bumper member 22 and transition flange 24, serves a retention function in retaining a door within a three-sided door frame or jamb assembly. The anchoring required for such door-to-frame retention is provided by affixing fixed side flange member 26 in flush surface contact with a frame member and affixing lip member 28 over a corner edge of the object pre-hung door assembly as shown in FIGS. 4A–4C. Staples or other suitable coupling means may be utilized to secure fixed side flange member 26 and the proximal flat end of lip member 28 to the sides of frame members or door edges.

As depicted in FIGS. 3A–3C, corner guard 20 has a substantially triangular overall profile with lip member 28 resting in its non-extended position. In this manner, and as depicted in FIGS. 4A–4C, corner guard 20 provides a geometrically robust triangular bracing structure for securing the two top corners of a pre-hung door assembly 35. This substantially triangular profile is maintained when corner guard 20 is deployed onto a top corner, which as previously explained, forms a right angle junction, such as that depicted in FIGS. 4A and 4C, showing corner guard 20 secured to a "top" corner region area at which head jamb 34 joins one of two side jambs (either a strike or a hinge jamb) 36. In this configuration, the distal end of lip member 28 extends in a substantially straight, non-flexed manner toward the right angle corner defined by the junction of head jamb 34 and side jamb 36.

In an important feature of the present invention, flexible lip member 28 enables corner guard 20 to assume a suitably different profile when corner guard 20 is deployed onto the L-shaped corner region of pre-hung door assembly 35. Specifically, and as depicted in FIGS. 4B and 4C, the flat strip portion of lip member 28 flexes in a bow-like manner at its free distal end, thus enabling an L-shaped or hook-like corner flange 25 to be secured onto the end of the vertical frame member over a range of different frame-member-to-door offset distances. Corner flange 25 preferably has a hook-like or L-shaped contour enabling corner flange 25 to conformably grip and cover the corner edge of the bottom of the object vertical frame member. The flat strip portion at the proximal end of lip member 28 is preferably secured to the bottom edge of door 32 by the use of staples (not depicted) or other suitable attachment means.

In a preferred embodiment, the frontal barrier member comprising bumper member 22 and transition flange 24, together with fixed side flange member 26 and outwardly extensible lip member 28 are integrally formed as a single plastic unit manufactured by injection molding or similar technique. Furthermore, the polymer or other plastic material utilized to integrally form corner guard as a single integral unit is characterized as having plastic resiliency, or "memory," such that in the absence of a flexing force, lip member 28 returns to its substantially straight, unflexed contour.

While this invention has been described in terms of several embodiments, it is contemplated that alterations, permutations, and equivalents thereof will become apparent to one of ordinary skill in the art upon reading this specification in view of the drawings supplied herewith. It is therefore intended that the invention and any claims related thereto include all such alterations, permutations, and equivalents that are encompassed by the spirit and scope of this invention.

What is claimed is:

1. A corner guard to protect a pre-hung door assembly comprising:

a frontal barrier member comprising a bumper member having a raised outer bumper surface and an inner base surface;

a fixed side flange affixed to said frontal barrier member and extending approximately perpendicularly with respect to the inner base surface such that a right angle inner surface corner contour is formed therebetween; and an outwardly extensible lip member affixed to said frontal barrier member and comprising a proximal end affixed to said frontal barrier member and a free distal end at which said lip member is extensible, wherein the proximal end of said lip member comprises a substantially flat strip member extending approximately perpendicularly with respect to the inner base surface of said frontal barrier member on the same side of the frontal barrier member as said fixed side flange, such that a right angle brace is formed between the inner base surface and the proximal end of said lip member, and wherein said substantially flat strip member is disposed approximately perpendicularly to said fixed side flange, said lip member further comprising a corner flange disposed at its distal end, whereby with said lip member outwardly extended relative to said frontal barrier member, said corner flange is disposed approximately parallel to said fixed side flange.

2. The corner guard of claim 1, wherein said frontal barrier member, said fixed side flange, and said lip member are formed as an integrally molded plastic unit.

3. The corner guard of claim 1, wherein said lip member corner flange curves inwardly.

4. The corner guard of claim 1, wherein said raised outer bumper surface is substantially flat.

5. The corner guard of claim 1, wherein the width-to-height ratio of said bumper member is at least 1.0.

6. The corner guard of claim 1, wherein said bumper member has a width between 1.25" and 1.50".

7. The corner guard of claim 1, wherein said bumper member has a height between 0.875" and 1.25".

8. The corner guard of claim 1, wherein said frontal barrier member further includes a substantially flat transition flange that couples said bumper member to the proximal end of said lip member.

9. A pre-hung door assembly comprising:

a door secured within a door frame, said door frame comprising two vertical frame members and a cross-frame member, the combination of which define four corners; and four corner guards attached respectively to the four corners of the door frame, wherein each of said four corner guards comprises:

a frontal barrier member disposed across the front of a one of said corners of the pre-hung door assembly; said frontal barrier member comprising a bumper member having a raised outer bumper surface and an inner base surface;

a fixed side flange affixed to said frontal barrier member and extending approximately perpendicularly with respect to the barrier surface provided by said frontal barrier member such that a right angle inner surface corner contour is formed therebetween; and an outwardly extensible lip member affixed to said door retention member and comprising a proximal end affixed to said frontal barrier member and a free distal end at which said lip member is extensible, wherein the proximal end of said lip member comprises a substantially flat strip member extending approximately perpendicularly with respect to the inner base surface of said frontal barrier member on the same side of the frontal barrier member as said fixed side flange, such that a right angle brace is formed between the inner base surface and the proximal end of said lip member, and wherein said substantially flat strip member is disposed approximately perpendicularly to said fixed side flange, such that in combination said lip member and said fixed side flange receive one of said corners, said lip member further comprising a corner flange disposed at its distal end, whereby with said lip member outwardly extended relative to said frontal barrier member, said corner flange is disposed approximately parallel to said fixed side flange.

10. The pre-hung door assembly of claim 9, wherein said corner flange and said fixed side flange of two of said four corner guards are secured to said cross-frame member, and wherein said corner flange and said fixed side flange of the remaining two of said four corner guards are secured to said vertical frame members.

11. The pre-hung door assembly of claim 9, wherein said frontal barrier member, said fixed side flange, and said lip member are formed as an integrally molded plastic unit.

12. The pre-hung door assembly of claim 9, said door having a bottom edge and each of said vertical frame member having a bottom end extending in offset manner below the bottom edge of the door to form an L-shaped bottom corner region of the pre-hung door assembly, and wherein with said lip member is outwardly extended said lip member corner flange is secured to the bottom end of the vertical frame member.

13. The pre-hung door assembly of claim 9, wherein said lip member corner flange curves inwardly.

14. The pre-hung door assembly of claim 9, wherein said raised outer bumper surface is substantially flat.

15. The pre-hung door assembly of claim 9, wherein the width-to-height ratio of said bumper member is at least 1.0.

16. The pre-hung door assembly of claim 9, wherein said bumper member has a width between 1.25" and 1.50".

17. The pre-hung door assembly of claim 9, wherein said bumper member has a height between 0.875" and 1.25".

18. The pre-hung door assembly of claim 9, wherein said frontal barrier member further includes a flat transition flange that couples said bumper member to the proximal end of said lip member.

* * * * *

US006971514C1

(12) EX PARTE REEXAMINATION CERTIFICATE (6362nd)

United States Patent

VanderWerf et al.

(10) Number: US 6,971,514 C1

(45) Certificate Issued: Aug. 12, 2008

(54) CORNER GUARD FOR PRE-HUNG DOOR ASSEMBLY

(76) Inventors: John D. VanderWerf, 467 Inland Way, Atlantic Beach, FL (US) 32233; Thomas E. Levitt, 13725 SW. 28th Ct., Beaverton, OR (US) 97008; Paul L. Verstrate, 790 SW. 238th Ave., Hillsoboro, OR (US) 97123

Reexamination Request:
No. 90/008,631, May 11, 2007

Reexamination Certificate for:

| | |
|---|---|
| Patent No.: | **6,971,514** |
| Issued: | **Dec. 6, 2005** |
| Appl. No.: | **10/657,975** |
| Filed: | **Sep. 9, 2003** |

(51) Int. Cl.
*B65D 81/07* (2006.01)

(52) U.S. Cl. ..... 206/325; 206/453; 206/586; 248/345.1

(58) Field of Classification Search ..... 49/380; 206/325, 453, 586, 345.1, 321, 599
See application file for complete search history.

(56) References Cited

U.S. PATENT DOCUMENTS 6,357,200 B1 3/2002 Vanderpan 6,725,604 B1 4/2004 Vanderpan

*Primary Examiner*—Matthew C. Graham

(57) ABSTRACT

An improved corner guard for use on a pre-hung door assembly. The corner guard of the present invention is designed for use with a pre-hung door assembly that includes a door secured within a three-sided door frame in which the two vertical frame members extend in an offset manner below the bottom edge of the pre-hung door. In a preferred embodiment, the corner guard includes a bumper member for imposing a gap between adjacent stacked assemblies. A substantially flat transition flange member is attached to one end of the base of the bumper member, and together, the transition flange member and bumper member base form a retention barrier surface across the front corner region of the pre-hung door assembly to maintain the door securely seated within the door frame. A fixed side flange is affixed to the other end of the bumper member and extends approximately perpendicularly with respect to the bumper member base surface such that a right angle inner surface corner contour is formed therebetween. The corner guard further includes an outwardly extensible lip member affixed to the other end of the transition flange member for enabling the corner guard to be deployed either to a right angle top corner or an L-shaped bottom corner region of the pre-hung door assembly.

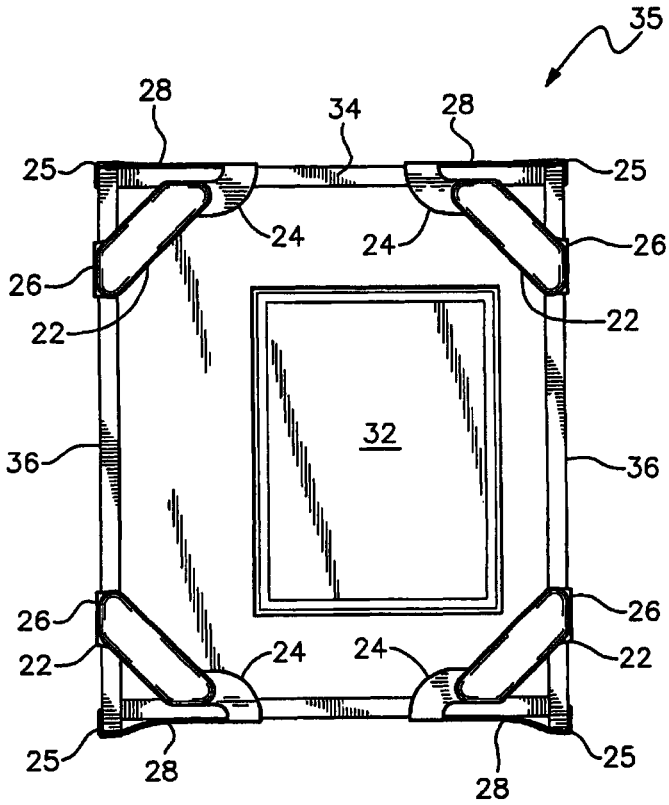

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 9 are determined to be patentable as amended.

Claims 2–8 and 10–18, dependent on an amended claim, are determined to be patentable.

1. A corner guard to protect a pre-hung door assembly comprising:

a frontal barrier member comprising a bumper member having a raised outer bumper surface and an inner base surface;

a fixed side flange affixed to said frontal barrier member and extending approximately perpendicularly with respect to the inner base surface such that a right angle inner surface corner contour is formed therebetween; and an outwardly extensible, *flexible* lip member affixed to said frontal barrier member and comprising a proximal end affixed to said frontal barrier member and a free distal end at which said lip member is *flexibly* extensible, *said lip member having a planar configuration when not extended outwardly and having a curved configuration when extended outwardly;* wherein the proximal end of said lip member comprises a substantially flat strip member extending approximately perpendicularly with respect to the inner base surface of said frontal barrier member on the same side of the frontal barrier member as said fixed side flange, such that a right angle brace is formed between the inner base surface and the proximal end of said lip member, and wherein said substantially flat strip member is disposed approximately perpendicularly to said fixed side flange, said lip member further comprising a corner flange disposed at its distal end *at an angle of less than 90 degrees*, whereby with said lip member outwardly extended relative to said frontal barrier member, said corner flange is disposed approximately parallel to said fixed side flange.

9. A pre-hung door assembly comprising:

a door secured within a door frame, said door frame comprising two vertical frame members and a cross-frame member, the combination of which define four corners; and four corner guards attached respectively to the four corners of the door frame, wherein each of said four corner guards comprises:

a frontal barrier member disposed across the front of a one of said corners of the pre-hung door assembly; said frontal barrier member comprising a bumper member having a raised outer bumper surface and an inner base surface;

a fixed side flange affixed to said frontal barrier member and extending approximately perpendicularly with respect to the barrier surface provided by said frontal barrier member such that a right angle inner surface corner contour is formed therebetween; and an outwardly extensible, *flexible* lip member affixed to said door retention member and comprising a proximal end affixed to said frontal barrier member and a free distal end at which said lip member is *flexibly* extensible, *said lip member having a planar configuration when not extended outwardly and having a curved configuration when extended outwardly;* wherein the proximal end of said lip member comprises a substantially flat strip member extending approximately perpendicularly with respect to the inner base surface of said frontal barrier member on the same side of the frontal barrier member as said fixed side flange, such that a right angle brace is formed between the inner base surface and the proximal end of said lip member, and wherein said substantially flat strip member is disposed approximately perpendicularly to said fixed side flange, such that in combination said lip member and said fixed side flange receive one of said corners, said lip member further comprising a corner flange disposed at its distal end *at an angle of less than 90 degrees*, whereby with said lip member outwardly extended relative to said frontal barrier member, said corner flange is disposed approximately parallel to said fixed side flange.

* * * * *